US012043996B2

(12) United States Patent
Johnston

(10) Patent No.: US 12,043,996 B2
(45) Date of Patent: Jul. 23, 2024

(54) RETRACTING SHOWER HOSE APPARATUS AND METHOD

(71) Applicant: G3 SERVICES LTD., Rochester (GB)

(72) Inventor: Gregg Johnston, Rochester (GB)

( * ) Notice: Subject to any disclaimer, the term of this patent is extended or adjusted under 35 U.S.C. 154(b) by 114 days.

(21) Appl. No.: 17/915,097

(22) PCT Filed: Mar. 24, 2021

(86) PCT No.: PCT/GB2021/050722
§ 371 (c)(1),
(2) Date: Sep. 27, 2022

(87) PCT Pub. No.: WO2021/191609
PCT Pub. Date: Sep. 30, 2021

(65) Prior Publication Data

US 2023/0151596 A1 May 18, 2023

(30) Foreign Application Priority Data

Mar. 27, 2020 (GB) ..... 2004487

(51) Int. Cl.
*E03C 1/06* (2006.01)
*E03C 1/02* (2006.01)
*E03C 1/04* (2006.01)

(52) U.S. Cl.
CPC ..... *E03C 1/06* (2013.01); *E03C 2001/026* (2013.01); *E03C 2001/0415* (2013.01)

(58) Field of Classification Search
CPC ..... E03C 1/06; E03C 2001/026; E03C 2001/0415; E03C 1/063
(Continued)

(56) References Cited

U.S. PATENT DOCUMENTS 2,898,605 A * 8/1959 Pearson ..... F16K 5/00 4/615
5,027,450 A 7/1991 Lang
(Continued)

FOREIGN PATENT DOCUMENTS

DE 4440995 A1 11/1994
EP 2674534 A1 * 12/2013 ..... E03C 1/0404
(Continued)

OTHER PUBLICATIONS

UK IPO, Combined Search and Examination Report under Section 17 and 18(3) relating to UK Application No. GB2004487.1, dated Oct. 22, 2020.
(Continued)

*Primary Examiner* — Lori L Baker
(74) *Attorney, Agent, or Firm* — The Harris Firm

(57) ABSTRACT

A retractable shower hose apparatus (11) has a housing enveloping a reel (21) mounted for rotation around an irrotatably axle (18). The axle (18) has a lumen (20) communicable with a shower valve supply of water whereby water can reach an axle port (19) disposed in a chamber (22) formed around the axle within the reel. The chamber (22) communicates with a shower hose reel coupling on the periphery of the reel to deliver water to the bore of the shower hose (24, 26). The reel has a depth equal to the diameter of the hose and is confined between closely fitting front and rear panels (12, 13) of the housing so that the hose can only coil radially out from the axis to a lead through (10). A coil spring (21.9) is disposed in the chamber (22) to act between the axle and reel and forcibly urge the hose to coil around the reel and retract into the housing.

18 Claims, 9 Drawing Sheets

(58) Field of Classification Search
USPC ... 4/678, 675, 567, 679, 378, 584, 613, 650, 4/668, 671
See application file for complete search history.

(56) References Cited

U.S. PATENT DOCUMENTS

| | | | | |
|---|---|---|---|---|
| 5,093,942 | A | 3/1992 | Lang | |
| 6,381,770 | B1 * | 5/2002 | Raisch | E03C 1/0404 4/678 |
| 6,381,774 | B1 * | 5/2002 | Wales | E03C 1/08 4/678 |
| 7,191,475 | B1 * | 3/2007 | Marcotte | E03C 1/0408 4/615 |
| 7,707,664 | B1 | 5/2010 | Flynn | |
| 2002/0042950 | A1 * | 4/2002 | Nasr | E03C 1/06 4/615 |
| 2016/0237661 | A1 * | 8/2016 | Teagarden | E03C 1/025 |
| 2019/0071851 | A1 * | 3/2019 | Meehan | E03C 1/06 |
| 2019/0224708 | A1 * | 7/2019 | Melle | B65H 75/4476 |

FOREIGN PATENT DOCUMENTS

| | | | | |
|---|---|---|---|---|
| GB | 2587689 | A * | 4/2021 | E03C 1/06 |
| JP | H07228431 | A | 2/1994 | |
| RU | 2705552 | C1 | 1/2018 | |
| WO | WO2007090311 | A2 | 8/2007 | |

OTHER PUBLICATIONS

ISA, International Search Report (ISR) relating to International Application No. PCT/GB2021/050722, dated Jul. 2, 2021.
ISA, Written Opinion of the ISA relating to International Application No. PCT/GB2021/050722, dated Jul. 2, 2021.

* cited by examiner

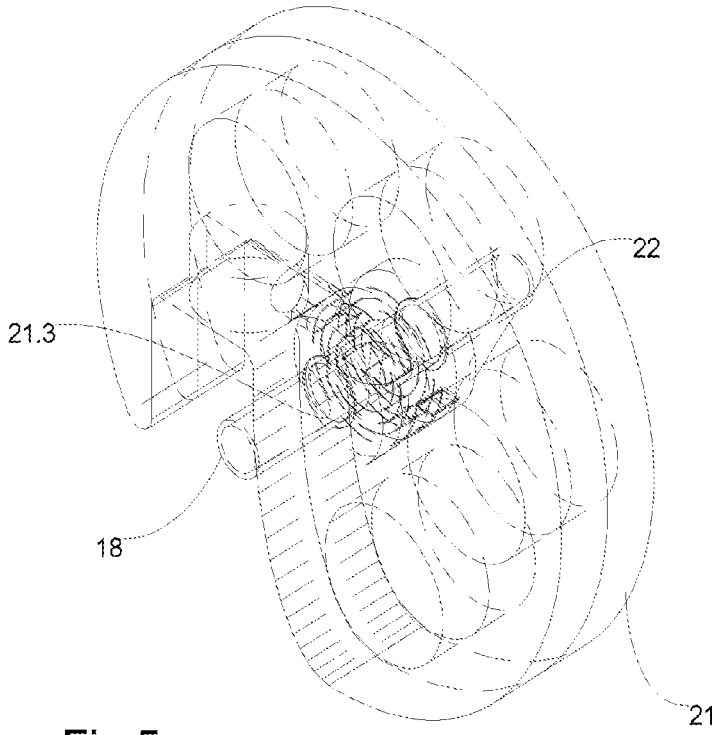
Fig 5
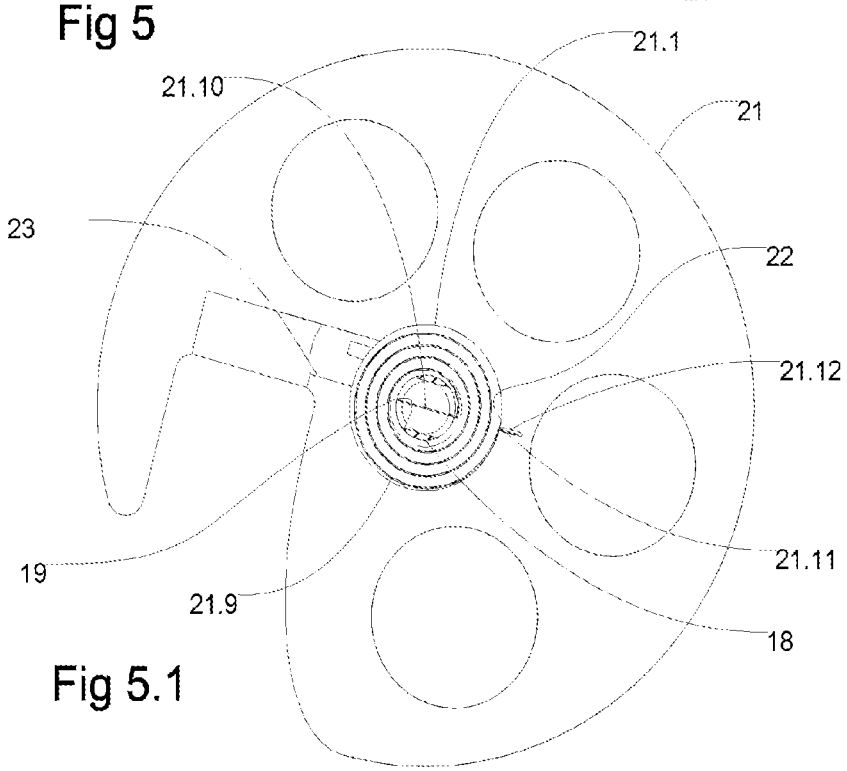
Fig 5.1

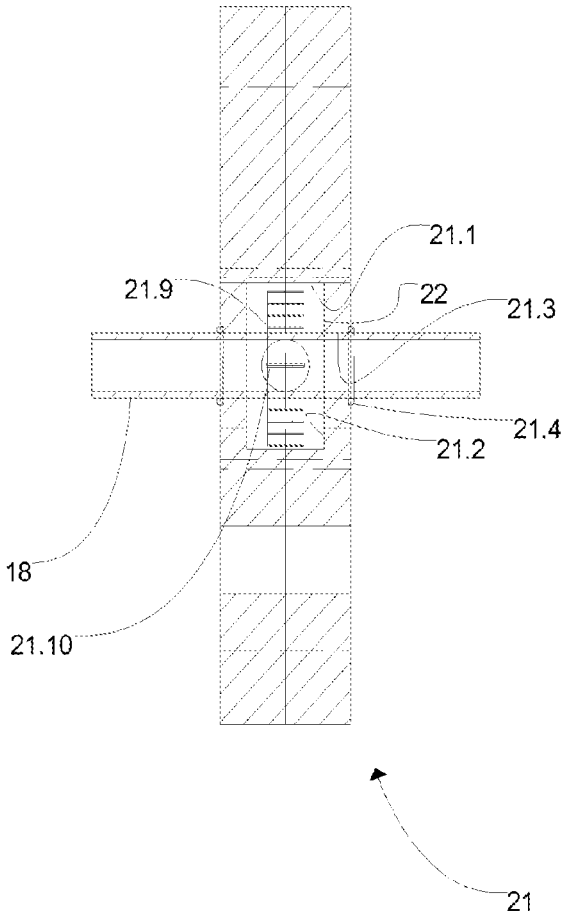
Fig 5.2

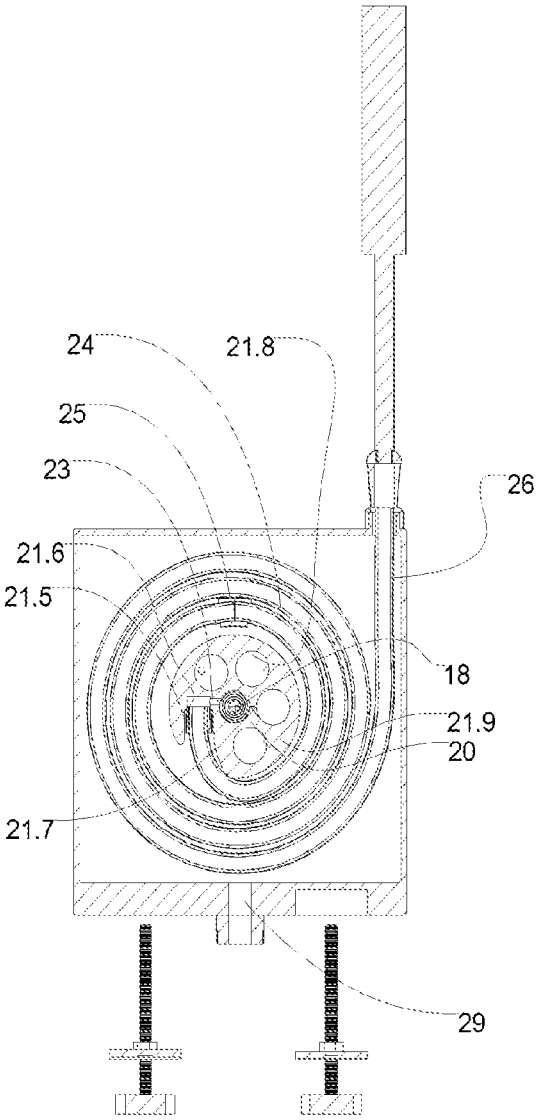
Fig 6.1
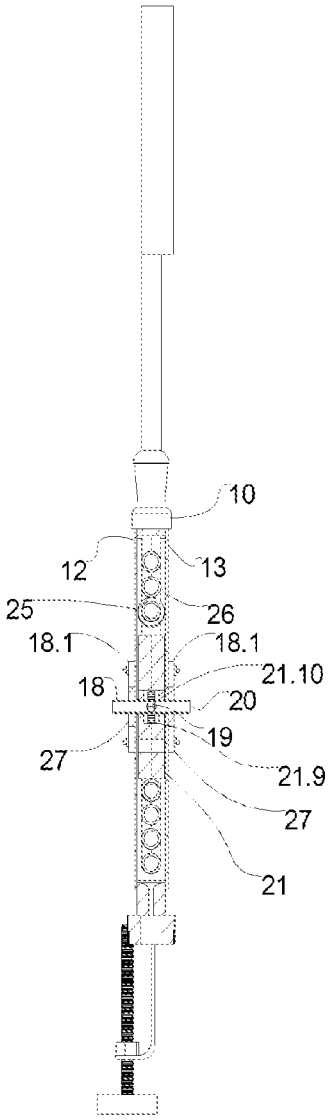
Fig 6.2

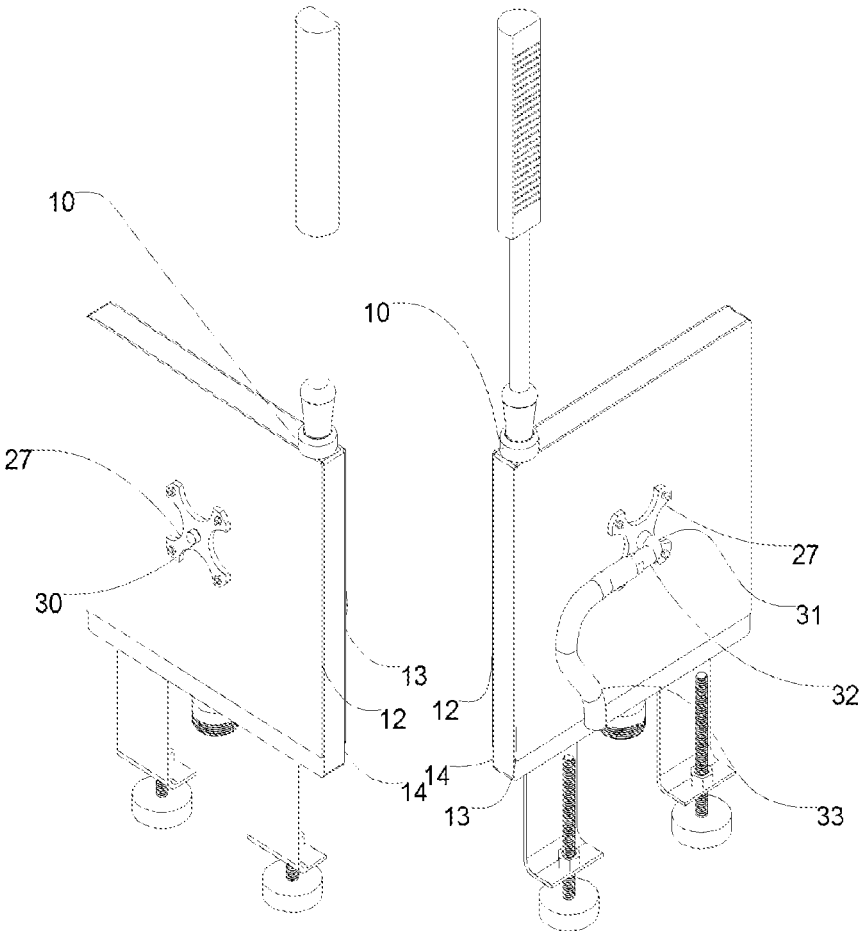
Fig 7.1
Fig 7.2

RETRACTING SHOWER HOSE APPARATUS AND METHOD

TECHNICAL FIELD

A bath comprises a tub with side walls upstanding from a bottom panel. The uppermost edge of the side walls are folded into a substantially horizontal rim. Taps and a shower apparatus are commonly supported on the rim at either of an end part of the rim or a side part of the rim. The sides and end of the bath are commonly decorated with cosmetic side or end panels or abut an adjacent wall. The retractable shower hose apparatus is known adapted to be fitted beneath the rim of a bath between the tub and either of decorative panels or a wall. In some installations the retractable shower hose apparatus may be installed in a recess formed in a wall or behind a wall adjacent the bath or a shower installation. Behind wall or in recess installations are sometimes necessitated by the confined space between the bath and adjacent wall.

PRIOR ART

A conventional retractable shower hose apparatus has an enclosing housing mounted beneath an end rim of the bath into which the shower hose can be pushed or drawn under its own weight. The hose simply folds into the housing. There are also installations of similar assemblies behind a vertical wall. In this case the shower hose has to be pushed into the hole as its own weight is rarely effective in retracting the hose.

The hose passes through a correspondingly sized close fitting hole formed in the rim of the bath or wall. The hole is usually finished with a "lead through" essentially a multipart annular ring which is secured into the hole in the bath rim. Usually the lead through contains some form of water seal in an effort to prevent water running between the hose and the housing and affords a decorative finish.

Shower hoses are commonly armoured with an articulated metal or plastics cover which is often of spiral form. As a result efforts to hydraulically seal the hose at the lead through are at best poorly effective and water commonly leaks into the housing. A drain may be provided in the bottom of the housing to remove inducted water. The drain typically communicates via a 5 mm hose with the bath overflow. However, it has been found that these frequently become clogged. Mould and bacterial slimes develop in the housing. This becomes foul over time leading to unwanted odours. Cleaning or clearing the housing drain is difficult since the housing is not user accessible being obscured behind cosmetic and occasionally structural features. Efforts to address these problems have hitherto met with very limited success, in part because the apparatus must be very compact in order to fit in the limited space between the end of the bath and a wall which commonly defines the end space into which the bath is fitted.

A further problem is wear and failure of the shower hose. A conventional shower hose is a readily replaceable component using simple threaded fittings to couple to a shower valve and a shower head. In the case of a retractable shower hose fitting, the shower hose to shower valve coupling is beneath the bath or behind a wall and therefore relatively inaccessible, commonly requiring the removal of at least cosmetic wall or bath panels to gain access. Even when access to the housing is gained the space for access to the hose/valve coupling is difficult and feeding the hose back through the lead through is challenging.

Known previous efforts to produce a spring powered reel which is capable of retracting a shower hose into a concealed housing have proven to be problematic because they have put a flange on each side of the reel and located the spring to one side of the reel resulting in an unacceptably wide apparatus which will not fit into many bath installations.

The reader may be further enlightened as to the state of the art by reference to the following prior art documents:

U.S. Pat. No. 7,707,664 discloses a bathroom cleansing apparatus for use by individuals when taking a shower. The bathroom cleansing apparatus is an improved showerhead which is attached to a length of flex hose. The flex hose itself is not normally visible when the shower head is not in use, but rather, is attached to a spool that is axially mounted behind a shower wall. The flex hose winds around the spool a few times before being attached to an incoming water line. The spool itself is attached to a torsion spring, which will cause the apparatus to slowly pull any extra length of flex hose not being used back onto the spool for later use.

JP H07228431 discloses a rubber hose storage reel. A rotary shaft is suspended on the side walls in a case, and reel members winding a rubber hose at an interval corresponding to the diameter of the rubber hose are supported on the rotary shaft. When the rubber hose is used, the reel members are erected from the case side, and the rubber hose is extracted. When the rubber hose is not used, the reel members are layed against the case side, and the rubber hose is stored in the case.

DE4440995A1 discloses a sanitary fitting, for shower and bath. The fitting has a discharge element on a hose, which can be rolled onto, and unrolled from, a reel. The reel is arranged on a support inside a casing, and may have a drive, such as a spring, in order to rewind the hose onto it. The reel may also be rewound manually, and a piece of hose may be fitted to a fixed water connection, in order to compensate for the rotation of the reel. The compensating and discharge hoses may also form a single hose. The casing may be concealed, and may have a front wall with a conduit for the hose.

RU2705552 discloses an extending hose device comprising a fluid connector, and sanitary shower sanitary-engineering installation comprising a hose container with a container retaining frame and a container body configured to detachably attach to the container retaining frame with a possibility of extension.

WO2007090311 discloses a pull-out shower. The pull-out shower has a shower head which is fixed to a flexible water pipe and which has a water-guiding passage in a housing. A button for actuating the outlet valve is arranged on the shower head. The shower head is connected to the flexible pipe via a joint. This increases the movability of the shower head and reduces the stress to which the flexible pipe is subjected.

SUMMARY OF INVENTION

Accordingly the present invention provides a retractable shower hose apparatus comprising:

an axle mounted irrotatably to span between front and rear members of a housing structure, said axle containing an axial axle passage to convey water from a shower valve coupling outside the housing to an axle port inside the housing;

a reel, mounted for rotation around the axle, said reel including a chamber arranged to receive water from the axle port at all angles of rotation;

a reel passage leading from the annular chamber to a hose reel coupling formed on the rim of the reel;

a spring arranged to act between the reel and one of the axle or housing to resist rotation of the reel in one direction and encourage rotation in the other direction.

According to a further aspect of the invention there is provided a method of installing a retracting shower hose apparatus comprising the steps of:

coupling a feed through of the shower hose apparatus to a hole prepared in the rim of a bath;

adjusting feet of the apparatus to engage the floor underlying the bath;

coupling a shower valve coupling to a shower valve water supply;

coupling the short length of hose clipped to the feed through to a long length of hose to be coupled to a shower head;

releasing the hose clip at the feed through to allow the long length of hose and the short length of hose to retract onto the reel.

The axle provides a valve port which can be communicated with the shower valve whereby water can pass from the shower valve through the valve port into a concentric passage in the axle and on through to the axle port. Because the axle does not rotate it provides a convenient coupling with the shower valve using conventional coupling means, for example compression fittings. The reel passage may extend radially through the reel to provide a passage for water to a hose reel coupling located toward the periphery of the reel.

The reel is formed with a chamber, which is preferably a concentric annular chamber around the axle communicating with the axle port. The reel may provide sidewalls to the chamber which are fluidically sealed against the axle by seals such as "O" rings. Thus water flows freely through the axle port into the chamber at any angle of rotation.

The housing structure is preferably an enclosure with the front and rear members provided by respective spaced front and rear upstanding walls. The walls may be supported by lower and upper panel parts and side walls parts to form a substantially sealed water tight housing. Axle clamps are provided to secure the axle irrotatably to one or each of the front and rear walls. The axle clamps may be releasable to enable the rotation of the axle relative to the reel. This allows the spring to be pre-loaded.

A lead through apparatus is provided in the upper panel part of the apparatus via which the hose can extend and retract. The lead through is adapted to mount into a hole provided in the rim of a bath so that any water entrained into the lead through by the hose runs into the housing. Conveniently height adjustable extensible feet depend from the housing to engage a floor or substitute structure in order to press the housing up against the underside of the rim and thereby securely mount the apparatus. Preferably the feed through is mounted on an upper panel of the housing at one side substantially intersecting a tangent to the coiled hose. The feed through in this arrangement facilitates installation of the housing in either of two orientations beneath the rim according to the space available beneath the bath rim which is commonly occupied by pipework and the bath drain or waste pipe.

The axle may be adapted to present two shower valve ports extending one each to the front and back of the housing. A cap may be provided to cap off one unused port. Alternatively the apparatus may be supplied with each shower valve port capped with a removable cap. This can obviate the problems caused by an installer forgetting to cap the unused port prior to mounting the apparatus. The arrangement allows the installer to fit the apparatus with the lead through to either of the left or right side of the bath, according to preference. The valve port, most readily available for communication with the shower valve can then be selected and coupled to the shower valve and the unused opposing valve port capped of.

A single full length shower hose may be attached to the hose reel coupling to coil around the reel and extend out through the lead through. However it is preferable that a relatively short length of hose is connected to the hose reel coupling and extends to a clip securing a coupling on the end of the short hose so that the coupling projects from the lead through during installation. The lead through is designed to cooperate with the clip or coupling to prevent the short hose coupling pulling back through the lead through. After installation the desired full length shower hose can be attached to the coupling and the clip disabled. The full lengths of both joined hoses can then be retracted into the housing. If the long hose needs to be replaced for any reason this can be achieved by extracting the hose until the coupling of the short and long hose is exposed and applying the clip to prevent retraction. The old long hose can then be easily separated and replaced. The lead through will have an upper part intended to be seated above the rim of the bath tub. The passage in the upper part of the lead through may be frusto-conical to reflect the frusto-conical coupling or handle on a shower head. Thus the shower head handle can seat firmly into the lead through without wobbling. This facilitates the design of the clip which can be provided by a separable ring or cable tie.

The housing separates the inside surfaces of the front and rear walls by the width of the reel. The width of the reel is substantially the same as the diameter of the hose to constrain the first and second length of hose to coil radially in a single layer. This prevents the hose jamming, minimises wear on the hose and keeps the depth (front to back) dimension of the apparatus to a minimum. Commonly depth is the dimension most restrictive to the installation of the apparatus; there is usually plenty of height space and length available. The reel can thus be a simple drum without side flanges to constrain coiling of the hose.

Preferably a drain is provided in the bottom panel part of the housing to remove entrained water from the housing. A drain hose coupling may be provided in communicating with the drain in the bottom of the housing whereby a drain pipe can be fitted to drain water from the interior of the housing to a waste. Preferably the drain pipe coupling and pipe has a bore of substantially the same diameter as the hose. A typical shower hose has an outside diameter between 12 and 20 mm particularly 16 mm. Using a drain hose coupling corresponding in size to the diameter of the hose minimises the risk of clogging and thereby facilitates draining water from the housing.

By having a first and second length of hose as defined in (2) above installation is simplified and the second length of hose (the only one visible in normal use) can readily be replaced without accessing the housing at all.

BRIEF DESCRIPTION OF DRAWINGS

Embodiments of a retractable shower hose apparatus according to the present invention will now be described, by way of example only, with reference to the accompanying illustrative figures; in which.

FIG. 5 is an enlarged isometric SW view of a reel from FIG. 4 showing hidden details;

FIG. 5.1 is a front elevation of the reel of FIG. 5 cut along a median plane perpendicular to the rotational axis of the reel;

FIG. 5.2 is a sectional side elevation on a section plane passing through the rotary axis;

FIG. 6.1 is a sectional front elevation sectioned on a plane bisecting the apparatus of FIG. 6 on a median plane;

FIG. 6.2 is a left side sectional elevation on a plane bisecting the apparatus through the rotary axis;

FIG. 7.1 is an isometric SE view of a first variant of the apparatus;

FIG. 7.2 is an isometric NE view of the first variant.

DETAILED DESCRIPTION

Figure 1:
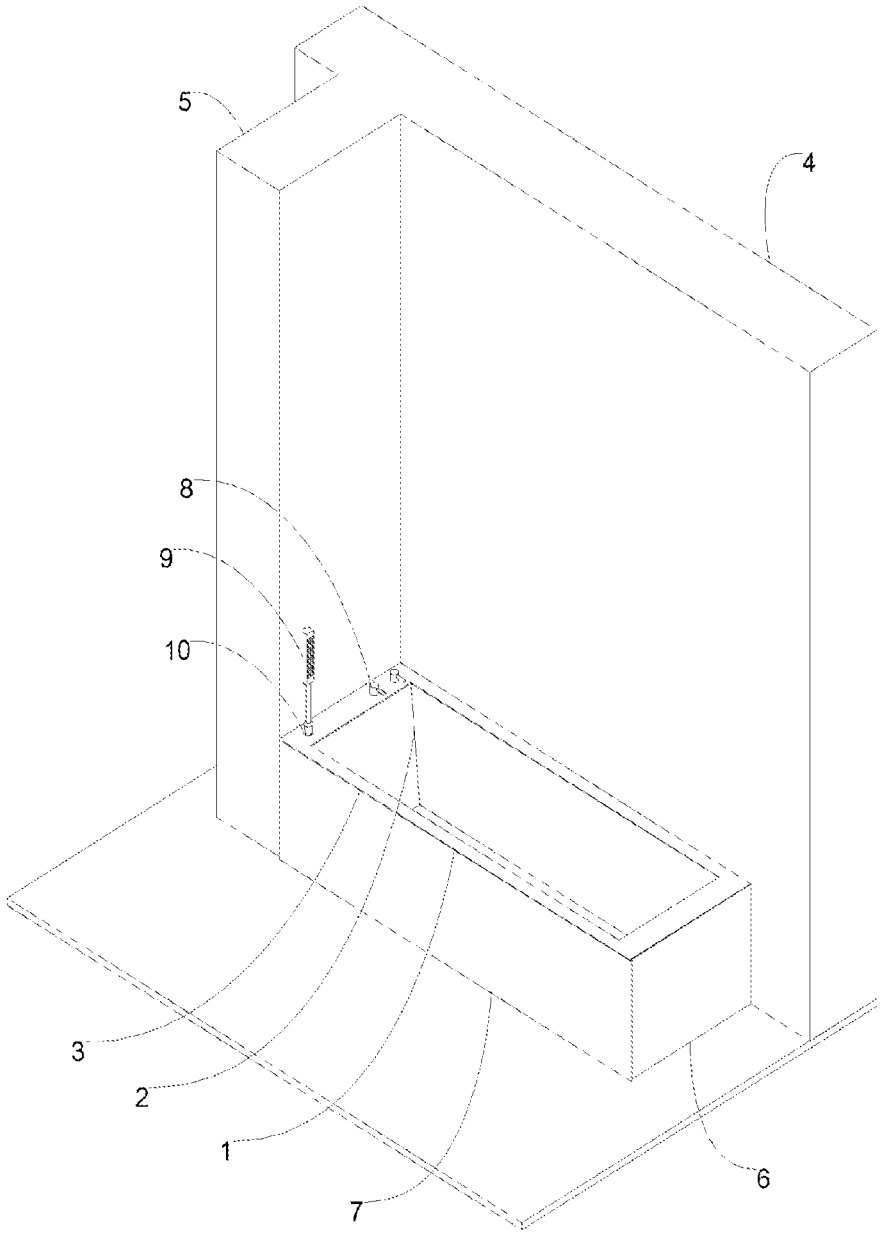
FIG. 1 is an isometric SE view of a typical bath installation with retractable shower hose.
Figure 2:
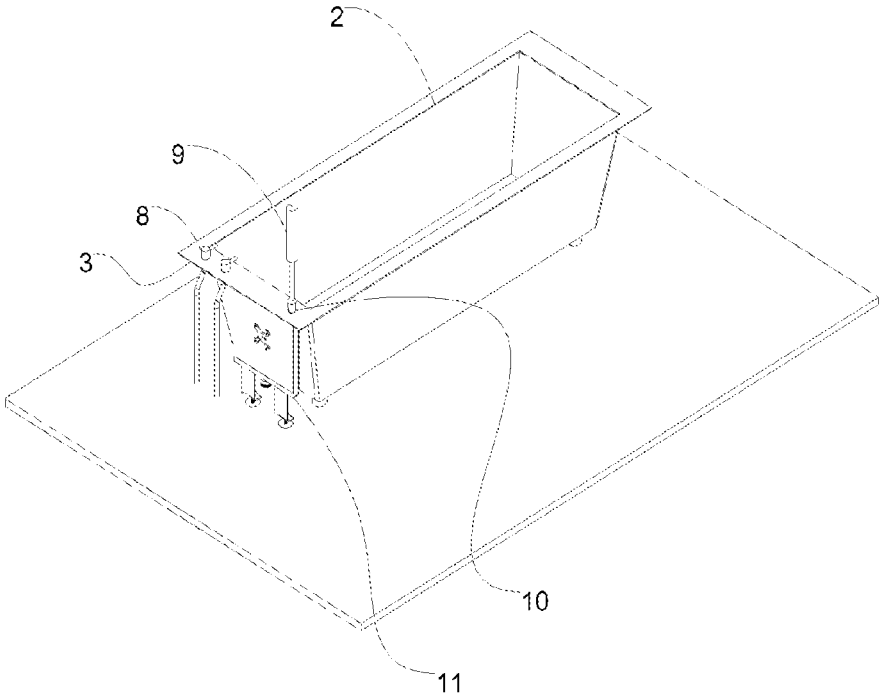
FIG. 2 is an isometric SW view of the bath installation with the walls removed to show the apparatus installed.
Figure 3:
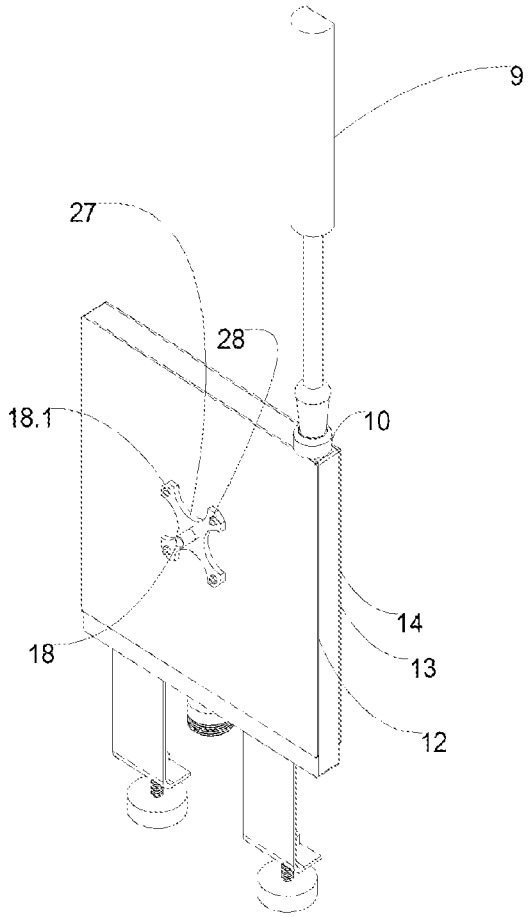
FIG. 3 is an enlarged isometric SW view of the apparatus.
Figure 4:
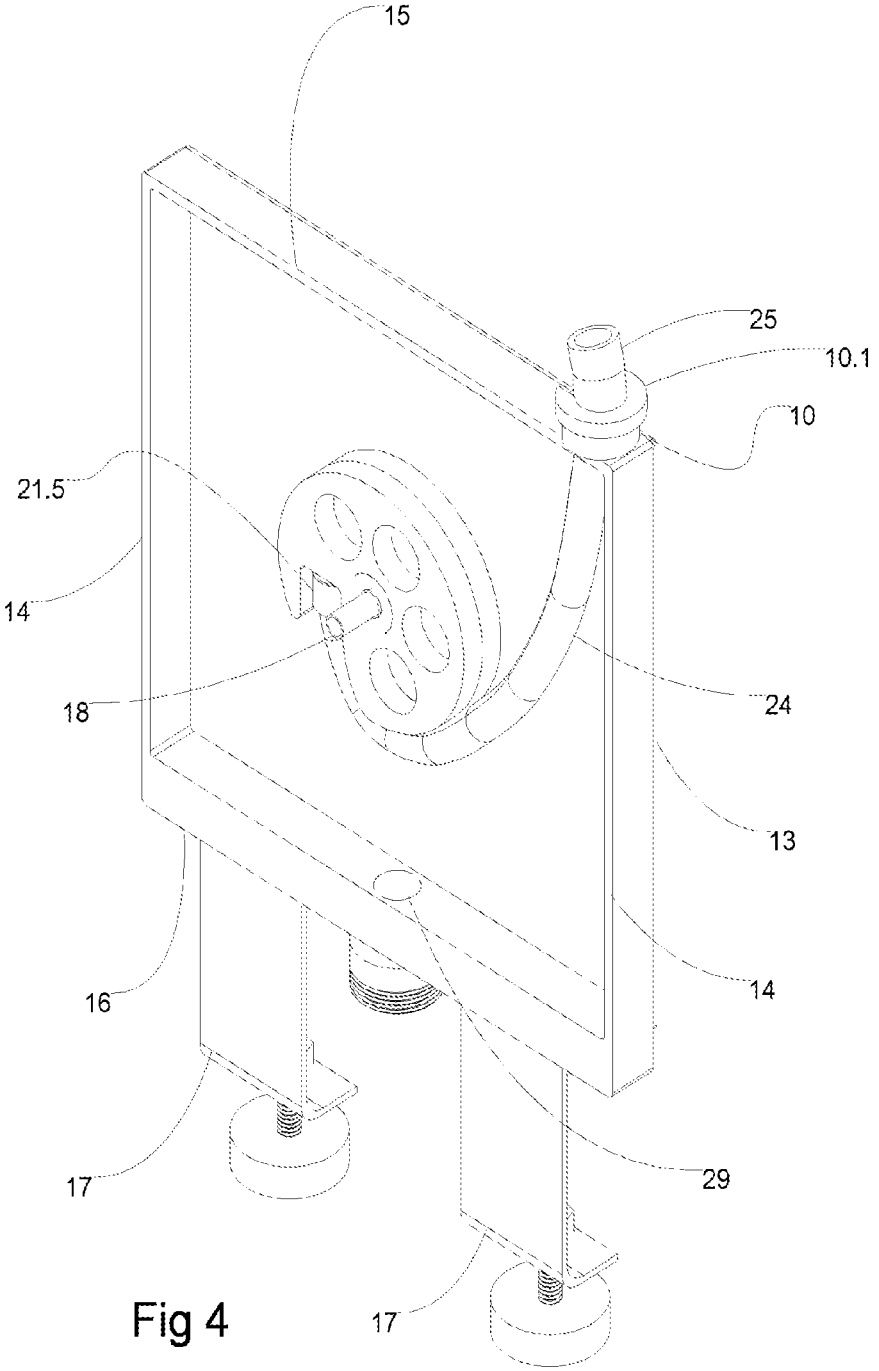
FIG. 4 is an enlarged SW isometric view of the apparatus in FIG. 3 with a front panel removed to show interior details.

FIG. 1 shows a typical bath installation having a floor on which a bath 1 is located. The bath 1 has a tub 2 surrounded by an integral substantially horizontal rim 3. The bath is installed against a side wall 4 and an end wall 5. A cosmetic end panel 6 and side panel 7 is fitted. Taps 8 are fitted to an end part of the rim in this case located to the right. A shower head 9 is mounted into a lead through 10 secured into a hole cut into the left side of the end rim of the bath.

A retractable shower hose apparatus 11 is installed beneath the end rim of the bath 1 to retract and conceal the shower hose when it is not in use. The apparatus 11 has a housing formed from a rectangular front panel 12 and a rear panel 13. Side walls 14, a top wall 15 and bottom wall 16 form a hydraulically sealed chamber in the housing. In this case the housing is rectangular as is the chamber but this is not essential.

The housing is supported by height adjustable ground engaging feet 17 which allows the height of the lead through 10, mounted on the top wall 15 to be inserted into a prepared hole formed in the rim by the installer.

An axle 18 is mounted to extend through each of the front and rear walls and is substantially centrally located. The axle 18 is engaged by anchors 18.1 which secure it irrotatably to the front and rear walls. The axle 18 is tubular having a lumen 20 extending from each side to an axle port 19. In the embodiment the axle is fabricated from a length of brass tube with an inside diameter of 10 mm and outside diameter of 13 mm to minimise friction at the seals. However a 15 mm outside diameter pipe could be used to cooperate with conventional pipe fittings. Either end of the axle may be fitted with an elbow fitting to be connected to a shower valve to receive water into the lumen. The other of the end will be capped to prevent leakage. This allows the water supply from the shower valve to be delivered to the front or back of the apparatus as is most convenient to the fitter.

In use water runs into the lumen 20 and out through the axle port 19. A reel 21 is mounted for rotation around the axle between the front and rear panels 12, 13. The reel is formed from mirror image left hand and right hand parts bonded together around an annular chamber 22. The annular chamber is formed in the reel 21 between the axle 18 and a shoulder 21.1 and the internal surface of a side wall 21.2. The axle 18 is received into the chamber via coaxial hole 21.3 formed in the side wall 21.2. An "O" ring seal 21.4 is mounted into an annular rebate formed around the hole 21.3 to hydraulically seal the chamber around the axle. The O ring seal 21.4 may be retained by cooperation with the respective front or rear panels where the axle passes through corresponding holes in the panels. Water running into the axle 18 from the shower valve (not shown) is communicated into the chamber 22. A radial passage 23 is formed in the reel to convey water from the chamber to a reel hose coupling 21.5. The reel hose coupling is a conventional threaded hose coupling screwed into a port 21.6 formed in the reel. The port 21.6 is formed tangential to the rotary axis. The periphery of the reel 21.7 presents a non-circular surface to a hose 24 so that the radius of curvature of the hose as it is wound onto the reel does not cause the hose to collapse and choke or kink. The peripheral surface begins adjacent the hose reel coupling and progresses radially and tangentially from the hose reel coupling 21.5 to an arcuate surface following a spiral path such that the surface has a radius substantially one hose diameter greater after circling the axis.

The reel 21 is formed with a plurality of voids 21.8 to minimise material wastage.

A spring is provided by a coil spring 21.9 acting between the axle 18 and the reel 21. The spring 21.9 has a tongue formation 21.10 which engages in the axle port 19. The spring spirals out from the axle port to an outer tongue formation 21.11 which engages in a retaining feature 21.12 formed in the shoulder of the reel.

Before installation a first short length of shower hose 24 runs to the lead through 10 where it terminates in a hose coupling 25 and is captured by a clip 10.1 at the lead through 10 so that it cannot accidently be drawn back into the housing. During installation the lead through is attached to the rim 3 of the bath from beneath and above, the side panel 7 being removed to provide the required access. The height of the feet 17 is adjusted to securely mount the apparatus. A second length of shower hose 26 is then attached to the hose coupling 25 together with the shower head 9. The clip 10.1 is then removed or otherwise disabled so that the second length of shower hose 26 can be drawn into the housing as shown in FIGS. 6 to 6.2.

Figure 6:
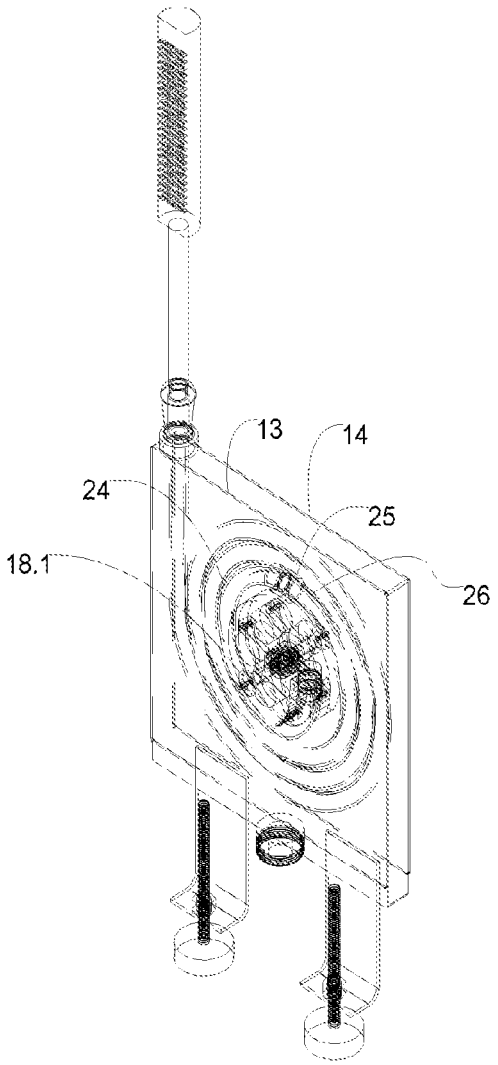
FIG. 6 is a SW isometric view of the apparatus showing hidden features of the reel and hose.

As can be seen in FIG. 6 the depth of the reel 21 is effectively the same as the space separating the front wall 12 and rear wall 13 so the hose is constrained to coil in a single radial layer by engagement with the front and rear walls. The depth of the chamber is substantially the diameter of the hose keeping the chamber dimensions minimal and facilitating fitting into the confined space beneath the bath rim. The internal chamber depth may be dimensioned to provide a loose running fit between the walls.

The axle 18 passes through an anchor passage in each of a pair of similar axle anchors 27. Each axle anchor 27 is irrotatably coupled to the axle 18 at the passage and is separably attached to the respective one of the front and rear panels by means of machine screw 28. Coupling to the axle may be achieved by adhesive bonding, soldering, welding or cooperable eccentric formations on the axle and anchor passage. The axle anchors 27 may be separated from the front and rear panels 12, 13 by undoing the machine screws. The anchors are formed with spokes to facilitate rotation of the axle against the spring force and allow the reel to be rotated with the spring to reel in the assembled hose and to pretension the spring. Each anchor 27 is then secured in place by means of the machine screws.

The feed through is located to one side of the housing, ie asymmetrically and substantially tangential to the coil, which facilitates smooth running of the hose. If the apparatus needs to be fitted with a right hand located shower it is a simple matter to rotate the apparatus housing about the vertical central axis during fitting because the shower valve coupling can be from either side of the axle.

Although the feed through is fitted with a seal to discourage water entering the chamber, water ingress is inevitable. The housing is provided with a drain port 29 with a bore similar to the diameter of the hose. The drain port can be communicated with a drain pipe or hose of similar diameter which will be communicated with the bath overflow or waste drain. The drain port may be fitted with a one way valve or trap to prevent waste water from backing up into the chamber.

The first variant illustrated in FIGS. 7.1 and 7.2 is generally the same as the previously described embodiment but differs in that one axle port 19 is permanently closed by a cap 30. The opposite axle port is coupled to an elbow fitting 31 which can be rotated around the axis of the axle 18. The elbow fitting 31 has an inlet port 32 internally threaded to receive a ⅜ inch BSP hose connector. Thus a supply hose 33 can be screwed into the inlet port 32 and connected to the shower valve (not shown) at the opposite end.

The invention claimed is:

1. A retractable shower hose apparatus characterized in that:

an axle is mounted irrotatably to span between front and rear members of a housing structure, said axle containing an axial lumen to convey water from a shower valve coupling outside the housing to an axle port inside the housing; a reel, mounted for rotation around the axle, said reel including a chamber arranged to receive water from the axle port at all angles of rotation and communicating with a hose reel coupling mounted on the rim of the reel capable of coupling with a shower hose;

a spring arranged to act between the reel and one of the axle or housing to urge the reel to rotate in order to coil the hose onto the reel and retract the shower hose into the housing.

2. An apparatus according to claim 1 wherein the axle provides a pair of valve ports, one at each of the front and rear of the apparatus whereby communication with a water supply can be achieved at either one of the valve ports.

3. An apparatus according to claim 1 wherein the housing has an upper part and a lead through is asymmetrically mounted on the upper part adjacent one edge.

4. An apparatus according to claim 1 wherein the spring is mounted in the chamber.

5. An apparatus according to claim 4 wherein the spring acts between the axle and the reel.

6. An apparatus according to claim 5 wherein an axle clamp acts between the axle and the housing structure to prevent rotation of the axle.

7. An apparatus according to claim 6 wherein the housing structure envelopes the reel and hose to trap any water entrained in the housing.

8. An apparatus according to claim 7 wherein seals are mounted to act between the axle and the reel to seal the chamber.

9. An apparatus according to claim 8 wherein the seals are mounted between front and rear panels which provide the front and rear housing members.

10. An apparatus according to claim 1 wherein a drain port is provided in a bottom part of the housing to drain entrained water to a waste pipe, said drain having a bore with a diameter similar to the shower hose.

11. An apparatus according to claim 1 wherein the depth of the reel and corresponding distance between the front and rear members of the housing is just sufficient to receive the outside diameter of a shower hose whereby the shower hose coils exclusively radially around the reel.

12. An apparatus according to claim 3 wherein the shower hose is capable of being assembled from a short length of shower hose capable of extending from the hose reel coupling to the lead through and a second long hose part coupled between the first shower hose part and a shower head.

13. An apparatus according to claim 12 having a clip to retain the end of the short hose remote from the hose reel coupling during installation, whereby after assembling the shower hose, substantially the whole the shower hose can be reeled back into the housing by the action of the reel and spring.

14. An apparatus according to claim 1 wherein a shower hose is coupled to the hose reel coupling and coiled onto the reel, said reel having a peripheral surface shaped to prevent the coiled shower hose kinking or choking.

15. An apparatus according to claim 1 wherein the hose reel coupling is secured to the reel with its axis substantially tangential with respect to the axis of rotation.

16. An apparatus according to claim 14 wherein the peripheral surface begins adjacent the hose reel coupling and progresses radially and tangentially from the hose reel coupling to an arcuate surface following a spiral path such that the surface has a radius substantially one hose diameter greater after circling the axis.

17. An apparatus according to claim 1 having height adjustable feet to support the housing by engagement with a floor.

18. A method of installing a retracting shower hose apparatus according to claim 12 comprising the steps of:

coupling a feed through of the shower hose apparatus to a hole prepared in the rim of a bath;

adjusting feet of the apparatus to engage the floor underlying the bath;

coupling a shower valve coupling to a shower valve water supply;

coupling the short length of hose clipped to the feed through to a long length of hose to be coupled to a shower head;

releasing the hose clip at the feed through to allow the long length of hose and the short length of hose to retract onto the reel.

* * * * *